US009321098B2

(12) United States Patent
Camagni et al.

(10) Patent No.: US 9,321,098 B2
(45) Date of Patent: Apr. 26, 2016

(54) PRESS FOR UPSETTING AN END OF A METALLIC MATERIAL PIPE

(75) Inventors: Roberto Camagni, Briosco (IT); Maurizio Cosolo, Magenta (IT); Angelo Furinghetti, Novara (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 356 days.

(21) Appl. No.: 14/115,607

(22) PCT Filed: May 3, 2012

(86) PCT No.: PCT/IB2012/052208

§ 371 (c)(1),
(2), (4) Date: Nov. 4, 2013

(87) PCT Pub. No.: WO2012/150564

PCT Pub. Date: Nov. 8, 2012

(65) Prior Publication Data

US 2014/0076020 A1 Mar. 20, 2014

(30) Foreign Application Priority Data

May 3, 2011 (IT) ..... MI2011A0740

(51) Int. Cl.
*B21J 5/08* (2006.01)
*B21J 9/06* (2006.01)
(Continued)

(52) U.S. Cl.
CPC . *B21J 9/06* (2013.01); *B21C 37/28* (2013.01); *B21J 5/08* (2013.01); *B21J 13/08* (2013.01); *B21J 13/085* (2013.01)

(58) Field of Classification Search
CPC ..... B21J 5/08; B21J 9/06; B21J 13/08; B21J 13/085; B21C 37/28
See application file for complete search history.

(56) References Cited

U.S. PATENT DOCUMENTS 1,683,661 A 3/1926 Felding
4,739,642 A * 4/1988 Redman ..... B21C 37/28 72/306

(Continued)

FOREIGN PATENT DOCUMENTS

CN 201609746 10/2010
FR 2526686 11/1983

(Continued)

*Primary Examiner* — David B Jones
(74) *Attorney, Agent, or Firm* — Stetina Brunda Garred & Brucker

(57) ABSTRACT

The present invention relates to an upsetting press (1, 1') for upsetting an end (2) of a metallic material pipe (3), e.g. for petroleum applications. The press (1, 1') comprises a supporting structure (10) which defines a working space and first locking means (15) for locking the pipe (3) to be upset. The press further comprises first upsetting means comprising at least one first upsetting die formed by a first pair of half dies (21, 22) which can be separated and closed about the end (2) of the pipe (3) to be upset and at least one axially movable cylindrical punch (30). The press (1, 1') further comprises die holding means which support the half dies (21, 22) moving them between a closing position and an opening position. According to the invention, the die holding means are independent from said supporting structure and are transversally movable (102) between an operating position in which the half dies (21, 22) can be closed about the end (2) of the pipe (3) to be upset and at least a non-operating position such that the half dies can be washed and/or lubricated outside the working space of the press.

15 Claims, 13 Drawing Sheets

(51) Int. Cl.
*B21C 37/28* (2006.01)
*B21J 13/08* (2006.01)

(56) References Cited

U.S. PATENT DOCUMENTS

2015/0096346 A1* 4/2015 Kirby ..... B21J 5/08
72/342.1
2015/0273567 A1* 10/2015 Mueller ..... B21J 13/085
72/360

FOREIGN PATENT DOCUMENTS

| | | |
|---|---|---|
| GB | 2089701 | 6/1982 |
| JP | 58009248 | 1/1983 |
| JP | 60003938 | 10/1985 |

* cited by examiner

PRESS FOR UPSETTING AN END OF A METALLIC MATERIAL PIPE

CROSS REFERENCE TO RELATED APPLICATIONS

The present application claims priority to PCT International Application No. PCT/IB2012/052208 filed on May 3,2012, which application claims priority to Italian Patent Application No. M12011A000740 filed May 3, 2011.

STATEMENT RE: FEDERALLY SPONSORED RESEARCH/DEVELOPMENT

Not Applicable.

BACKGROUND

1. Field of the Invention

The present invention relates to the field of upsetting processes and plants for metallic material products, such as, for example, petroleum extraction application pipes. In particular, the invention relates to an upsetting press for upsetting the end of a previously heated metallic material pipe. The present invention further relates to a method for upsetting the end of a metallic means pipe by means of said upsetting press.

2. State of the Art

It is known that metallic material pipes having one or both upset ends are used in some industrial areas. An example is that of extraction of petroleum in which wide use of these pipes is made. In particular, the pipes intended for this type of application are commonly known as "oil-hearing pipes". In order to allow the connection of oil-bearing pipes, one end of each pipe is either externally or internally threaded to allow to connect to another pipe, with or without the help of a sleeve. Before threading, the end of the pipe undergoes a so-called upsetting operation by means of which the thickness of the end itself is increased. This operation is normally carried out by means of devices called upsetting presses. Upsetting presses are divided into two main families according to their operation.

A first family consists of mechanical presses is which, the moving parts are actuated by engaging the member to be moved to a flywheel which is kept turning by means of a motor. The second family consists instead of hydraulic presses in which the members or operating member assemblies are actuated by hydraulic means.

Traditional hydraulic presses comprise a supporting structure which defines a longitudinal axis along which the pipe to be upset is arranged. The latter is inserted in the press after the end to be upset has been heated is a few minutes from ambient temperature to a temperature of approximately 1200 degrees centigrade. After having been inserted in the press, the pipe is blocked by means of locking means which keep it in a predetermined position along the longitudinal axis.

The end to he upset is closed between a pair of half dies which define a die for the upset material. With this regard, upsetting is carried out by means of the action of a punch which enters into the pipe axially at the end to be upset. In particular, the punch has a first tapered portion the larger diameter of which is substantially equivalent to or smaller than that of the inner cavity of the pipe and a second portion of diameter larger than the inner diameter of the pipe and substantially equivalent to Ore outer diameter of the upset pipe. The penetration of the second cylindrical portion into the end causes the local compression of the healed metallic material, which is reallocated according to the shape of the die.

Normally, hydraulic presses comprise locking means of the half dies which allow the latter to maintain the correct position during punch penetration. The latter is normally actuated by means of a piston which operates at a second side of the press opposite to the side where the pipe being machined is inserted and extracted.

It is similarly known that the upsetting of an cod of an oil-bearing pipe may be completed with "one blow" or "two blows". In the first case, upsetting is completed with a single die and a single penetration of one punch after heating. In the two blow case, the upsetting process includes a first upsetting made by means of a first die and a first punch, and a second upsetting, immediately after the first, made by means of a second die, different from the first and a second punch, different from the first. In some cases, the oil-bearing pipes require a third upsetting of the same end, i.e. "three blows", which is normally made after having heated the end to be upset a second time.

It is equally known that at the end of each upsetting operation, the die and the punch used must be necessarily cooled (e.g. with water) and lubricated (e.g. with graphite) in order to he used again. Indeed, these maintenance interventions (washing-lubrication) are absolutely necessary due to the temperature reached by the material and the constant presence of oxides formed at this temperature. Normally, the half dies and the punch are cooled and lubricated by means of appropriate devices which are actuated as soon as the upsetting operation has beers completed.

In traditional hydraulic upsetting presses, the dies are supported by appropriate die holding means rigidly connected to the supporting structure of the press.

These die holding means move the half dies between a closing position about the end to be upset and an opening position, in which the half dies are separated and can thus be cooled and lubricated. This opening condition of she half dies allows the pipe to move into and out of the press. In nearly all cases, the half dies maintain a position substantially inside the supporting structure of the press also in the opening position thereof. This essentially means that the half dies are cooled and lubricated within the working space of the press defined by the supporting structure.

It has been seen that this aspect is critical for various reasons, the first of which is the need to make the supporting structure larger in size to support the die holding means and to guarantee sufficient space for the washing and indication devices at the same time. Another critical aspect is the tact that the water and the graphite used for cooling and lubricating mix and deposit on the movable members of the press, accumulating at the bottom of the supporting structure. This fact leads to an increase of cleaning and maintenance operation frequency of the supporting structure and of the other parts of the press to avoid undesired looking or malfunctioning of the press itself. This obviously translates into an increase of dead times, i.e. a decrease of productivity.

Another drawback of the current presses, determined by the constantly "inner" position of the half dies and their direct connection to the supporting structure, is identified in the difficulty of replacing a pair of half dies with another, e.g. when a batch of pipes with features different from the previous one most be upset or simply when the half dies so longer guarantee the minimum required tolerances due to wear. It has indeed been seen that the replacement of the half dies is currently an operation which requires the intervention of particularly skilled, attentive expert personnel. Indeed, the weight of the dies' and the need to move between the inner parts of the press itself makes the preparation-replacement operation of the half dies (press setup) particularly long and delicate.

FIG. 1 relates to a "two blow" upsetting press 200 of known type. The press 200 comprises a supporting structure defined by a pair of crosspieces 250 connected by longitudinal beams 260 parallel to the longitudinal axis 211 of the press. The press 200 comprises a pair of upper half dies 201 each supported by first arms 202 rotating about a same rotation axis, corrected in position over the longitudinal axis 211 of the press, so as to move the upper half dies 201 between the closing condition and the opening condition. The same press 200 also comprises a pair of lower half dies 205 supported by second arms 206 rotating about a rotation axis, connected m position under the longitudinal axis 211 of the press 200, so as to move the lower half dies 206 between the closing position and the opening position.

In addition to the drawbacks already mentioned above, the hydraulic press in FIG. 1 has a further negative aspect related to the position of the lower half dies 205. Indeed, it has been seen that oxides farmed as a result of the temperature higher than 600°-700° degrees centigrade are released by the pipe when it is inserted in the press. Such oxides detach from the surface of the pipe and precipitate onto the lower half dies 205 and onto the mechanical parts which allow the correct movement thereof. Consequently, the tolerances of such lower half dies 205 may be altered due to the presence of these oxides, thus negatively reflecting on the quality of the upsetting and thus on the functional reliability of the press. Furthermore, such oxides may compromise the operation of mechanical parts thus determining possible interruptions of operation or longer dead times.

A further example of a two blow upsetting press of known type is described in patent application JP 60003938. Such a press comprises a supporting structure defined by a pair of fixed cross-pieces connected by longitudinal beams parallel to the longitudinal axis of the press. A first punch and a second punch are connected to the opposite ends of a first rotation arm. This turns along the middle line thereof about a first longitudinal beam between an angular position and an angular position in which one of the two punches remains within the working space of the press and the other remains outside the same space. The press described in JP 60003938 comprises a pair of first die holding members each of which supports a half die of a first die and a pair of second die holding members, each of which supports a half die of a second die. The press further comprises a first locking crosspiece operatively associated to the first die holding members. In particular, the latter move axially in the first locking crosspiece between a first axial position, in which they are closed about the end, and a second axial position in which they ate separated. The second die holding members move similarly with respect to the second locking crosspiece.

The two locking crosspieces arc installed on opposite ends of a second rotating arm which turns on its middle line about a second longitudinal beam, different from the first, so as to turn between two angular positions in which, when reached, one of the two locking crosspieces (e.g. the first) is located inside the working space of the press and the other locking crosspiece (the second, to continue the example) is located outside the same working space.

The press described in application JP 60003938 has various drawbacks which make it absolutely inaccurate, not very reliable and not very productive. It is worth noting that, for example, in this press each one "blow" would require in sequence: inserting the pipe, carrying out the upsetting operation, further moving the pipe in the direction of insertion, opening the dies and finally repositioning the pipe again for the next blow. In other words, in the described press, it is not in tact possible to separate the half dies used unless tire upset pipe is moved towards the inside the press itself. Indeed, the position occupied by the pipe during upsetting and the presence of its upset end prevents the axial opening movement of the half dies. The need to move the pipe to separate the half dies introduces in fact a further step of the process which negatively increases the overall cycle time increasing the risk of possible positioning errors of the pipe for the second blow at the same time.

A further aspect of the solution described in application JP 60003938 is identified in the necessary over-dimensioning of the supporting structure so that the press works in safety conditions. Indeed, the high weight of the dies necessarily means that the longitudinal beams which support the rotating arms must be large in size. Furthermore, it is worth noting that due to the high weight of the dies arms must rotate and dies must he positioned slowly, i.e. at slow speed. This aspect also negatively increases process times and decreases the end product quality at the same time. Indeed, the temperature of the pipe inevitably decreases in the interval of time between the first and the second upsetting blow. It is thus apparent that a prolonged interval of time, due to the slow rotation of the arms, determines a strong decrease of the temperature of the pipe, i.e. conditions which are not acceptable for the second upsetting blow.

Finally, it is worth noting that also in the press described in JP 60003938 the cooling and the lubrication of the half dies after each blow are rather difficult and accompanied by undesired effects. Indeed, the water-graphite mixture reduces the efficiency and accuracy of the rotation devices of the rotating arms requiring frequent maintenance also in this case. Furthermore, the rotation devices may also be damaged by the oxides which remain on the half dies after each upsetting blow and can precipitate onto the rotation devices of the arms during the rotation of the same.

On the basis of these considerations, it is apparent the need for new solutions which allow to overcome the drawbacks indicated above accompanying the upsetting presses of the prior art.

SUMMARY OF THE INVENTION

It is thus a main task of the present invention to provide an upsetting press of an end of an oil-bearing pipe which allows to solve the drawbacks indicated above. Within the scope of this task, a first object is to provide a press in which the cooling and lubrication of the dies and punch is rapid and effective. Another task is to provide a press in which the upsetting means may be easily replaced rapidly and without the need to avail of expert personnel and/or complex and dedicated equipment. Another object of the present invention is to provide a press which implements a high-productivity two-blow upsetting process with a short cycle time. Yet another object is to provide a press which implements a high-speed one-blow process. Not last object of the present invention is to provide an upsetting press which is reliable and easy to make at competitive costs.

This task and these objects are reached by means of an upsetting press for upsetting and end of a metallic material pipe, which comprises;

a supporting structure, which defines a longitudinal axis of the press and a transversal direction substantially orthogonal to said longitudinal axis, said structure delimiting a working space of said press;

first locking means adapted to lock the pipe in a predetermined position along said longitudinal direction;

first upsetting means comprising:

at least one first upsetting die incorporating two first half dies which can be separated and closed around the end of the pipe to be upset;

at least a punch movable along the longitudinal axis between a first axial position and a second axial position, at least one of said first or second axial positions being characteristic of a condition in which the punch is inserted in said end of the pipe to be upset;

first die holding means, which support said first half dies moving them from an approaching position, in which said first half dies are mutually closed, and a distancing position, in which said first half dies are distanced;

second locking means for locking said first half dies in a closing position in which the two first half dies are in contact defining said first die.

According to the invention, the first die holding means are independent from the supporting structure and are movable along a direction parallel to said transversal direction between an operating position, in which the half dies of the first die may be closed about said end of said pipe, and at least one transversal non-operating position outside the working space defined by said structure in which, when reached, said first half dies can be cooled/lubricated outside the working space itself.

According to a further aspect of the present invention, said first punch is movable along a direction parallel to said transversal direction between at least one operating position, in which the axis of the first punch is aligned with the longitudinal axis of said press, and at least one non-operating position outside the working space of said press so that said punch may be cooled and/or lubricated outside the working space itself.

According to the present invention, the upsetting means are thus moved in a transversal direction from an operating position, inside the working space defined by the supporting structure, to a position outside the working space itself in which the means themselves can be cooled and lubricated. The possibility of carrying out these operations outside the machine allows to preserve the internal working parts. Furthermore advantageously, at said non-operating position, upsetting means may be possibly replaced rapidly and without employing expert personnel. Furthermore, it is worth noting that the possibility of arranging die holding means independent from the supporting structure, i.e. not rigidly connected to the same, allows to advantageously simplify the supporting structure and thus contain the weight of the supporting structure.

The present invention further relates to a method for upsetting the end of a metallic material pipe by means of the press according to the present invention and as shown in claim 13 and in the claims dependent therefrom.

BRIEF DESCRIPTION OF THE DRAWINGS

Further features and advantages of the present invention will be apparent in light of the detailed description of preferred, but not exclusive, embodiments of an upsetting press for pipes for petroleum applications illustrated by way of non-limitative example, with the aid of the accompanying drawings, wherein.

DETAILED DESCRIPTION OF THE INVENTION

Figure 1:
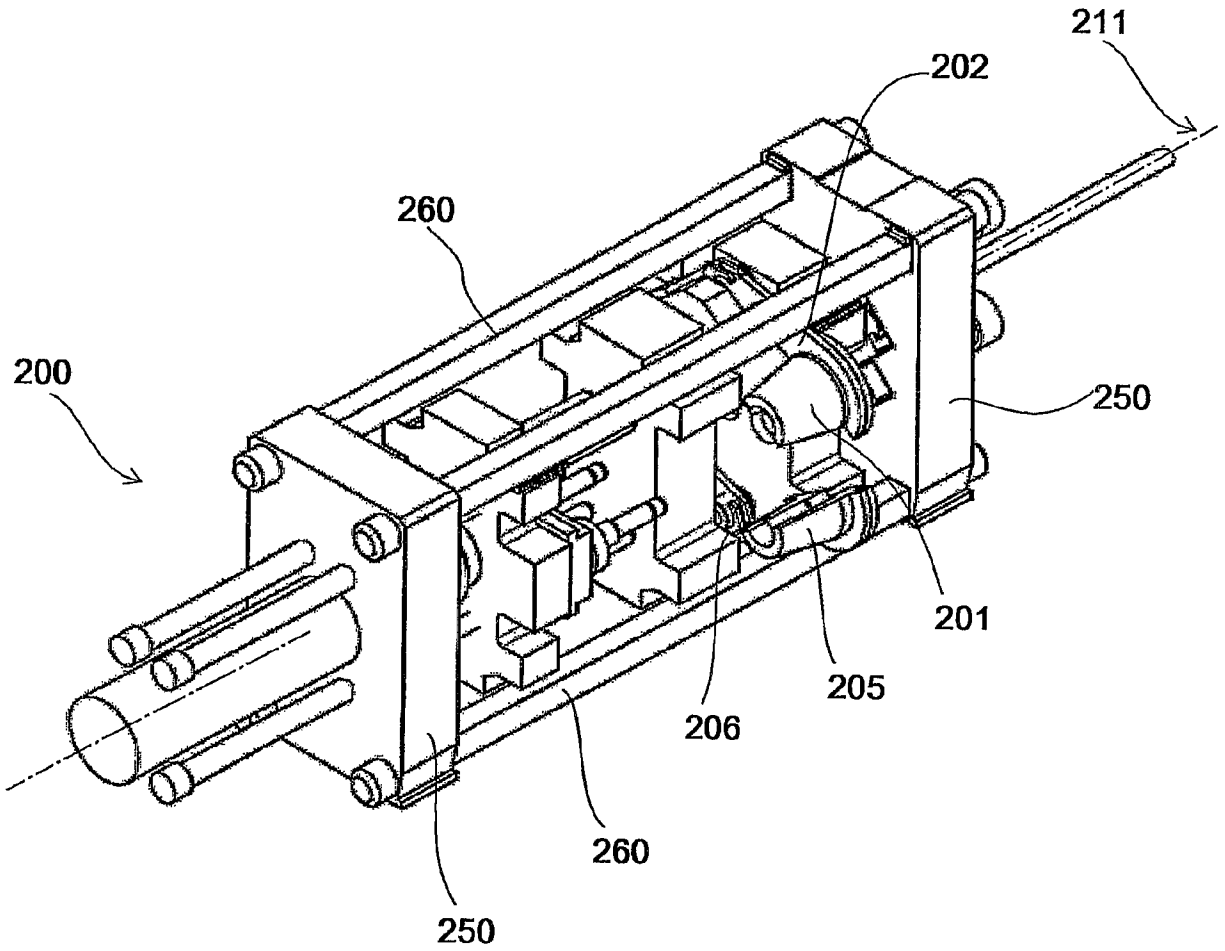
FIG. 1 is a perspective view of an upsetting press for metallic material pipes of known type.

Figures from 2 to 6 relate to a first possible embodiment of a press according to the present invention, while figures from 7 to 15 relate to a second possible embodiment. In both eases, the press 1 according to the present, invention may be used for upsetting the end 2 of a metallic material pipe 3 which may be used, for example, in the field of extraction of petroleum. For the purposes of the present invention, the word "pipe" indicates any internally hollow metallic material product which develops about a rectilinear axis and has any transversal section (evaluated according to a plane orthogonal to sate rectilinear axis).

With reference to the first embodiment, the press 1 according to the present invention comprises a supporting structure 10 which defines a longitudinal axis 101 of the press 1 and a transversal direction 102 orthogonal to said longitudinal axis 101. As described in greater detail below, the pipe 3 is positioned so that the longitudinal axis thereof is aligned with the longitudinal axis 101 of the press 1.

Figure 2:
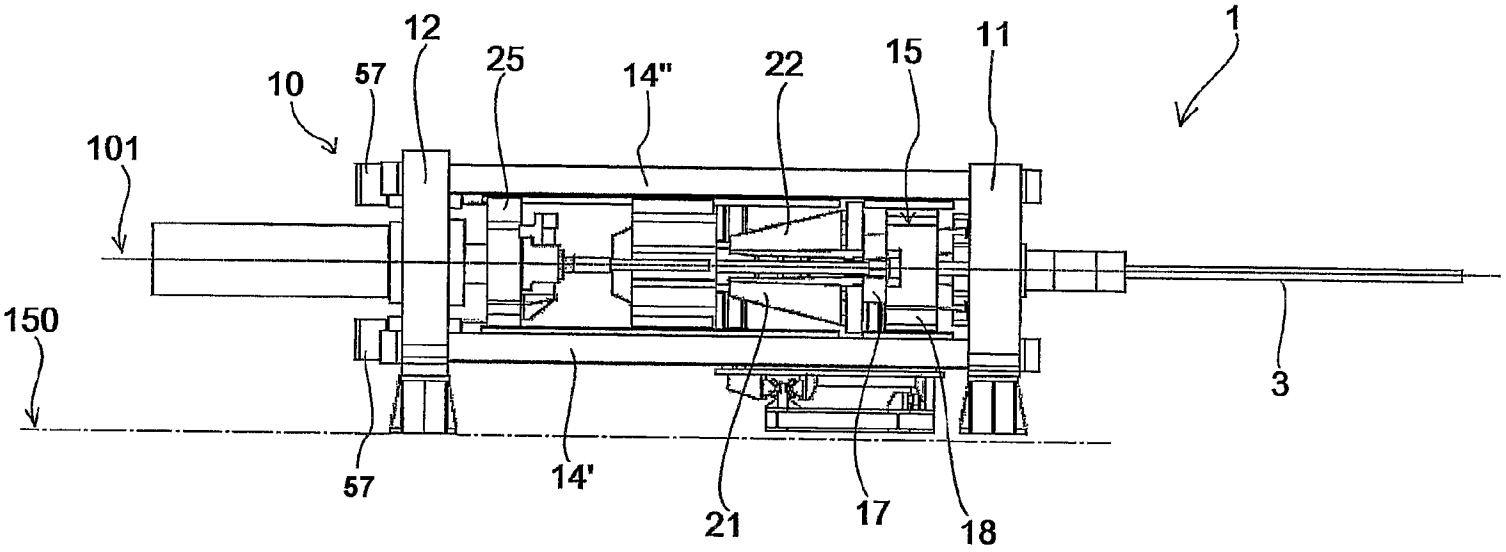
FIG. 2 is a side view of a first embodiment of the press according to the present invention.

The structure 10 preferably rests on a horizontal plane 150 indicated in FIG. 2. The longitudinal axis 101 is parallel to said horizontal plane 150 and is contained in a vertical plane 150' (indicated in FIG. 4) substantially orthogonal to said horizontal plane 150. The transversal direction 102 is thus orthogonal to said vertical plane 150'.

Figure 4:
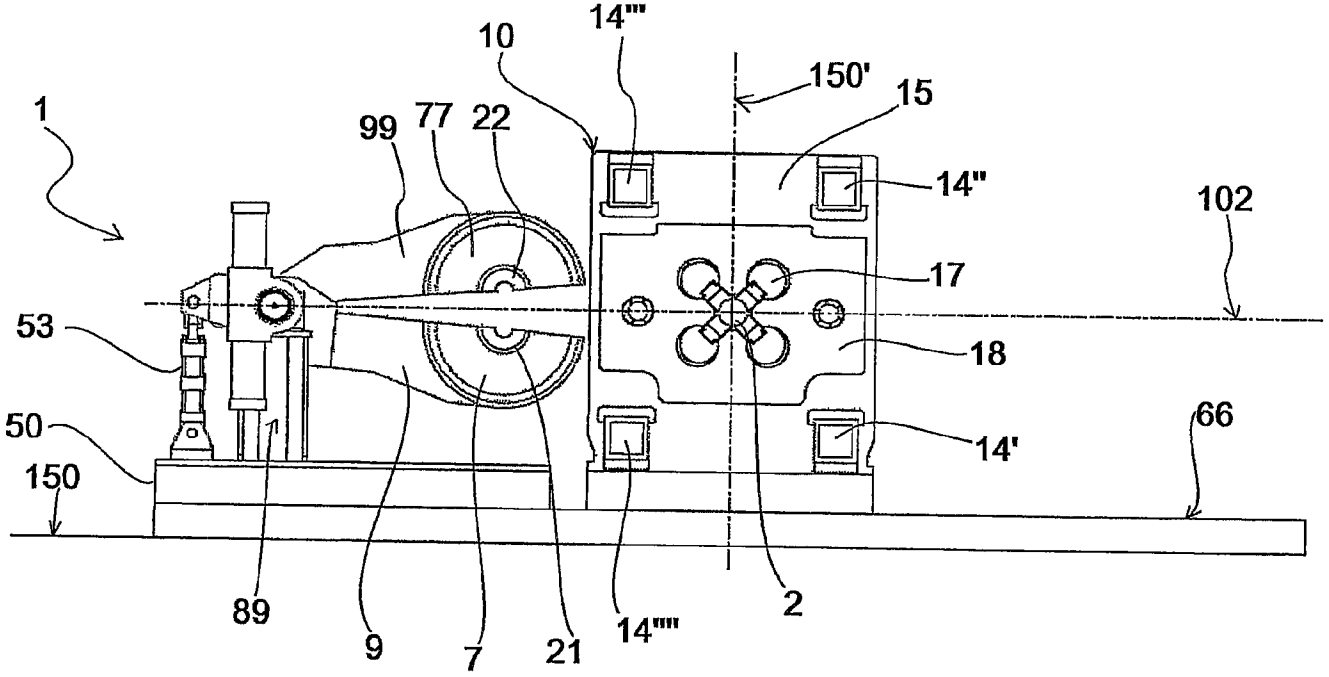
FIG. 4 shows a section view taken along line IV-IV in FIG. 3.

The supporting structure 10 comprises 8 first fixed crosspiece 11 and a second fixed crosspiece 12 which are developed transversally to said longitudinal axis 101 defining an insertion and extraction side of the pipe a into/from the press 1. The structure 10 comprises a plurality of longitudinal guiding and supporting beams 14', 14", 14'", 14'" which connect the first fixed crosspiece 11 to the second fixed crosspiece 12. With reference to FIG. 4 in particular, a first pair of reciprocally parallel longitudinal beams 14', 14" are arranged on a first side with respect to said vertical plane 150', while a second pair of reciprocally parallel longitudinal beams 14'", 14"" are arranged on a second side with respect to the same vertical plane 150' in position symmetric to that of the longitudinal beams 14', 14" arranged on said first side.

The structure 10 defines a working space of the press 1, i.e. a space within which the parts of the press 1, described below, used for upsetting the end 2 of the pipe act. In particular, for the purposes of the present invention, the expression "working space" means a space transversally comprised (i.e. along said transversal direction 102) between—said first pair of longitudinal beams 14', 14" and said second pair of longitudinal beams 14''', 14"" and longitudinally delimited by said first fixed crosspiece 11 on one side and by said second fixed crosspiece 12 on a second side.

The press 1 comprises first locking means for locking the pipe 3 in a predetermined position along sale longitudinal axis 101. Such first locking means comprise a first movable locking crosspiece 15 supported by the longitudinal beams 14', 14", 14''', 14"" in position proximal to the first fixed crosspiece 11. The first crosspiece 15 comprises a plurality of internal jaws 17 adapted to contact the outer surface of the pipe 3. The first crosspiece 15 further comprises an outer feeding body 18 coupled to the inner jaws 17 by means of conical surfaces so that a longitudinal translation movement of the feeding body 18, in a first sense, is translated into a radial closing movement of the inner jaws 17, and a translation movement of the body 18, in a second sense, opposite to the first is translated into a radial opening movement of the inner jaws 17 themselves.

The first locking means further comprise first hydraulic means for translating the body 18 parallel to the longitudinal axis 101. Such first hydraulic means preferably comprise a plurality of jacks 56 adapted to feed the body 18 towards/away from the first fixed crosspiece 11 determining. In this manner, the closing/opening of the inner jaws 17, i.e. the locking/unlocking of the pipe 3.

The press 1 according to the invention comprises first, upsetting means comprising at least one first die defined by two first half dies 21, 22 which can be separated and closed about the end 2 to he upset of the pipe 3. The upsetting means further comprise a first punch 30 movable along the longitudinal axis 101 between a first axial position and a second axial position at least one of which characteristic of a condition in which the punch is inserted in the end 2 to be upset. The first punch 30 has an intrinsically known configuration with a first tapered portion 31, the larger diameter of which is substantially equivalent to or smaller than that of the inner cavity of the pipe 3, and a second cylindrical position 32, the diameter of which is larger than that of the inner cavity of the pipe 3 but smaller than the outer diameter of the first die.

The press 1 comprises first die holding means which support the first half dies 21, 22 of the first die. Such first die holding means move the first half dies 21, 22 between an approaching position, in which they are mutually approached, and a distancing position (or also opening position), in which the same are separated and distanced. From an operating point of view, the first half dies 21, 22 are brought to the approaching position before the upsetting blow, i.e. before the first punch 30 is actuated. The first half dies 21, 22 are instead brought to the distancing (opening) position after completing the blow.

According to a possible operating mode of the press 1, the approaching position may substantially coincide with a "closing position" of the first two half dies 21, 22. In particular, for the purposes of the present invention, the expression "closing position" indicates a position in which the first half dies 21, 22 are in contact about the end 2 to be upset and they define the first die. The reaching of such a closing position is obviously necessary and preparatory to any upsetting blow.

According to a preferred operating method of the press 1, the approaching position does not however coincide with the newly defined closing position but is a position in which the first half dies 21, 22 surround the end 2 to be upset, but are not in contact with the end itself. As explained in greater detail below, the closing of the first half dies 21, 22 (i.e. the reaching of the closing position) is determined by an action carried out by second locking means (defined below).

The first die holding means comprise first die holding members 7, 77 each of which comprises a body in which one of said first half dies 21, 22 of said first die is housed. More specifically, with reference to FIG. 4, a first die holding member 7 (or lower die holding member 7) supports a lower half die 21 and a second upper die holding member 77 (or upper die holding member 77) supports an upper half die 22. The body of the die holding members 7, 77 has a half cone shape so that the body itself is substantially tapered in direction of the second fixed crosspiece, 12, i.e. in die direction of insertion of the pipe 3. The first die holding means further comprise a pair of rotating arms 9, 99, each of which supports at one end said die holding members 7, 77. As apparent again in FIG. 4, a first arm 9 (or lower arm 9) supports the lower die holding member 7 and a second arm 99 (or upper arm 99) supports the upper die holding member 77. Such rotating arms 9, 99 rotate in opposite senses about a rotation axis 103 (indicated in FIG. 3) substantially parallel to the longitudinal axis 101 of the press 1 essentially moving the first half dies 21, 22 between the closing position and the opening position. The rotation axis 103 of the arms 9, 99 is defined by a shaft 60, about which the arms themselves are hinged. Such a shaft 60 is installed on a supporting base 89 (indicated in FIG. 4).

The first die holding means further comprise second hydraulic means for allowing the rotation of the arms 9, 99 indicated above. In particular, such means comprise one or more hydraulic jacks 53 each acting on m end of one of the two arms 9, 99 opposite to the ends which support the corresponding die holding member 7, 77 (also see FIG. 4).

Figure 3:
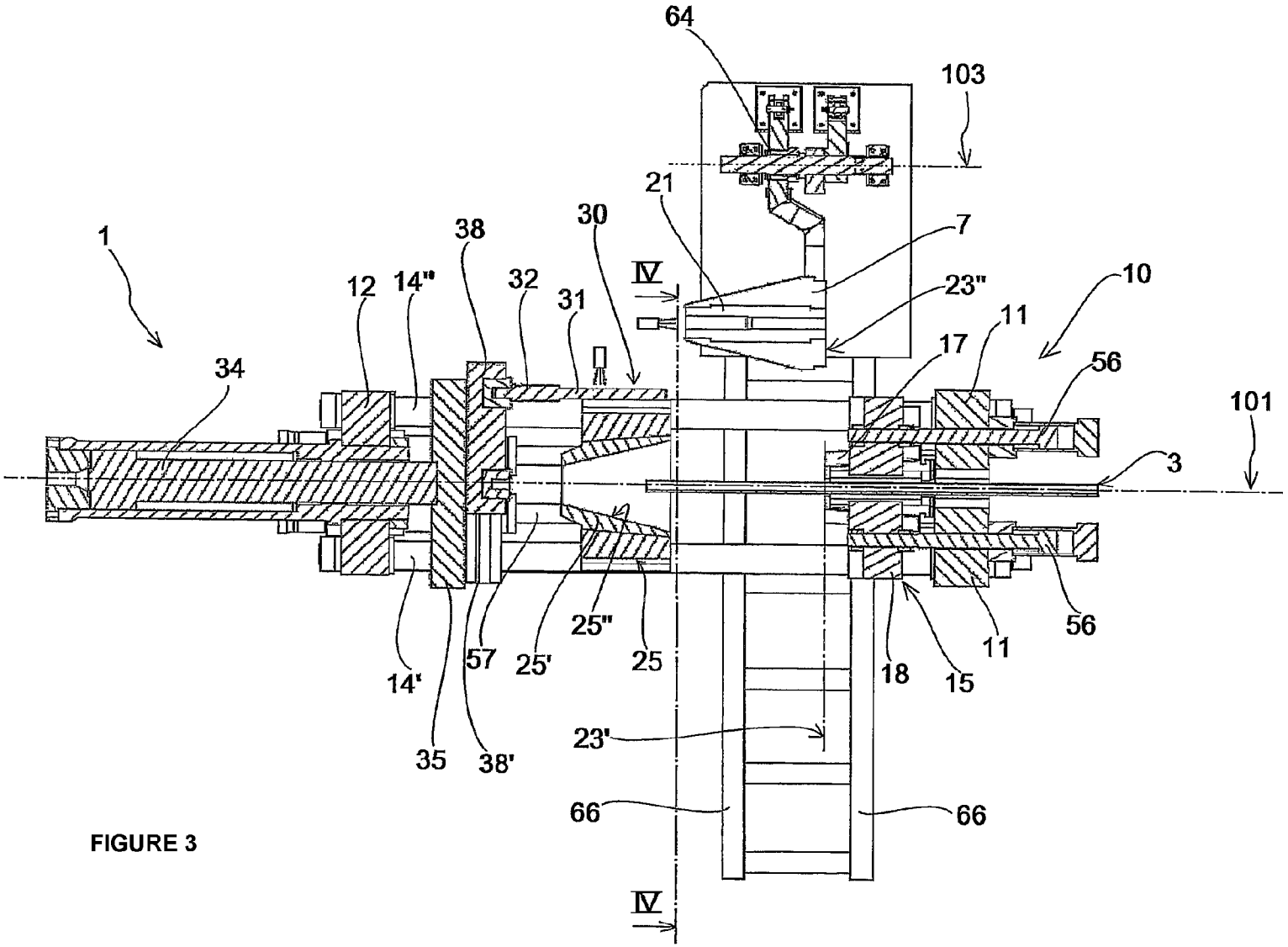
FIG. 3 is a plan view of the press in FIG. 2 in a first operating configuration.

The press 1 according to the invention comprises second locking means for locking the first half dies 2, 22 of the first die. With this regards, FIG. 3 shows in detail a preferred embodiment of the second locking means which comprise a second crosspiece 25 movable along said longitudinal axis 101 between a locking position, in which the crosspiece exerts a closing force on said first half dies 21, 22 and a non-locking position. Such a second movable crosspiece 25 comprises an inner portion 25' which defines a tapered surface 25" conforming to the outer surface of the bodies of the first die holding members 7, 77. The second locking means former comprise third hydraulic means for moving fire second crosspiece between the locking position and the non-locking position. Also in this ease, such third hydraulic means comprise a plurality of jacks 57 which push and pull the second crosspiece 25.

From the functional pond of view, when the first two half dies 21, 32 reach the approaching position about the end 2 to be upset of the pipe 3, the second crosspiece 25 is shifted towards the locking position to close and lock the first two half dies 21, 22 in the closing position. The taper of the inner portion 25' and of the bodies of the die holding members 7 allow the closing and sealing of the first half dies 21, 22 during the penetration of the first punch 30 in the end to upset, i.e. during the upsetting blow.

The reaching of the closing position by the first half dies 21, 22 is thus determined by an action of the second crosspiece 25 during the movement of the same towards the locking position. This solution is particularly advantageous because it allows to contain the decrease of temperature to which the end 2 is subjected when, the first half dies 21, 22 are in the closing position. When the pipe 3 is inserted in the press. Indeed, the temperature of the end 2 is decreased by radiation outwards. When the half dies 21, 22 come into contact, the decrease of the head of the end 2 is faster doe to thermal, conduction through the same half dies 21, 22. Consequently, the temperature of the end 2 is lowered drastically to the detriment of the final quality of the upsetting. This aspect is particularly critical above all when the press is used for two-blow upsetting.

The particular approaching position (not coinciding with the closing position) combined with the closing of the first half dies 21, 22 by means of the second crosspiece 25 is a solution which allows to advantageously limit thermal dispersion by conduction to the time needed for upsetting only. Indeed, the first half dies 21, 22 maintain the closing position substantially only in the interval in which the second crosspiece 25 remains near the locking position and in the locking position. With this regard, it is worth noting that at the end of the upsetting blow, as soon as the second crosspiece 25 moves towards the non-locking position, the first half dies 21, 22 are opened rapidly towards the opening position restoring a radiation condition.

According to the present invention, the first die holding means are independent from the structure 10 and are movable along a direction parallel to said transversal direction 102 between an operating position and a non-operating position. In particular, the expression "operating position" of the first die holding means corresponds to a first transversal position reached by the first means themselves such that the first two half dies 21, 22 can be closed about said end 2 to upset it. The expression "non-operating position" of the first die holding means corresponds instead to a second transversal position, external to the working space, reached by the first die holding means, different front said first transversal position, such that the first half dies 21, 22 can be cooled and/or lubricated outside the working space itself defined by the structure 10 of said press 1.

The press 1 comprises transversal moving means of said first die holding means which allow the movement of the first die holding means between the operating position and the non-operating position. Such first transversal moving means comprise a first carriage 50 on which there are installed the first die holding means and a plurality of guides 66 which allow the moving of said first carriage 50 according to a direction parallel to said transversal direction 102. The use of the first moving means independent from the structure 10 is particularly advantageous because it allows not only to carry out the maintenance intervention on the first half dies 21, 22 outside the press 1, but also allows an easy, fast replacement of the dies themselves. With this regard, it is worth noting that after having reached the non-operating position, the first carriage 50 may also be directly replaced with another carriage already equipped with other die holding means which support another die. This expedient allows to minimize the setup times of the press 1 with obvious advantages in terms of productivity.

According to a preferred embodiment of the invention also the first punch 30 is movable along a direction parallel to said transversal direction 102 between an operating position of the first punch 30 and a non-operating position of the first punch 30. In particular, the expression "operating position of the first, punch 30" indicates a position such that the axis of the first punch 30 is substantially aligned with the longitudinal axis 101 of the press 1, while the expression "non-operating position of the first punch 30" means a position, external to the working space of the press 1, in which the same may be cooled and/or lubricated.

As apparent, e.g. from FIG. 3, the dimensions of the first punch 30 are smaller than the dimensions of the first die holding means. Furthermore, the conformation of the first punch 30 itself makes the same much easier to cool and lubricate with respect to the first half dies 21, 22. Consequently, the transversal stroke of the punch 30 may be advantageously shorter than that needed for the first die holding means. With this regard, it is worth noting that the press 1 comprises first treatment means 91, this expression meaning means arranged to cool and lubricate one pair of half dies. Such first treatment means are actuated when said first die holding means reach the non-operating position. The press 1 further comprises second treatment means 92 far cooling and lubricating the first punch 30 when it reaches the non-operating position indicated above.

With reference again to FIGS. 3 and 5, the press 1 further comprises axial actuating means to axially move the first punch 30 between the first, axial position and the second axial position indicated above. In particular, such axial actuation means comprise a thrust crosspiece 35 supported and guided by the longitudinal beams 14', 14", 14", 4"" of the supporting structure 10. The axial actuating means farther comprise a thrust rod 34 connected to the thrust crosspiece 35 and hydraulically actuated. In particular, such a pressure rod 34 protrudes through the second fixed crosspiece 12 of the structure 10 of the press 1.

The press 1 farther comprises transversal moving means of the first punch 30 which make it indeed movable between the operating position and the non-operating position defined above, Such means comprise a slide 38, on which, said first punch 30 is mounted, and a rectilinear guiding member 38' integral with the thrust, crosspiece 35 so that is parallel to the transversal direction 102. The transversal moving means of the first punch 30 further comprise fourth hydraulic means (not shown in the figures) for moving the slide 38 between at least one first transversal position and a second transversal position, characteristics of said operating position and said non-operating position of said first punch 30, respectively.

Figure 5:
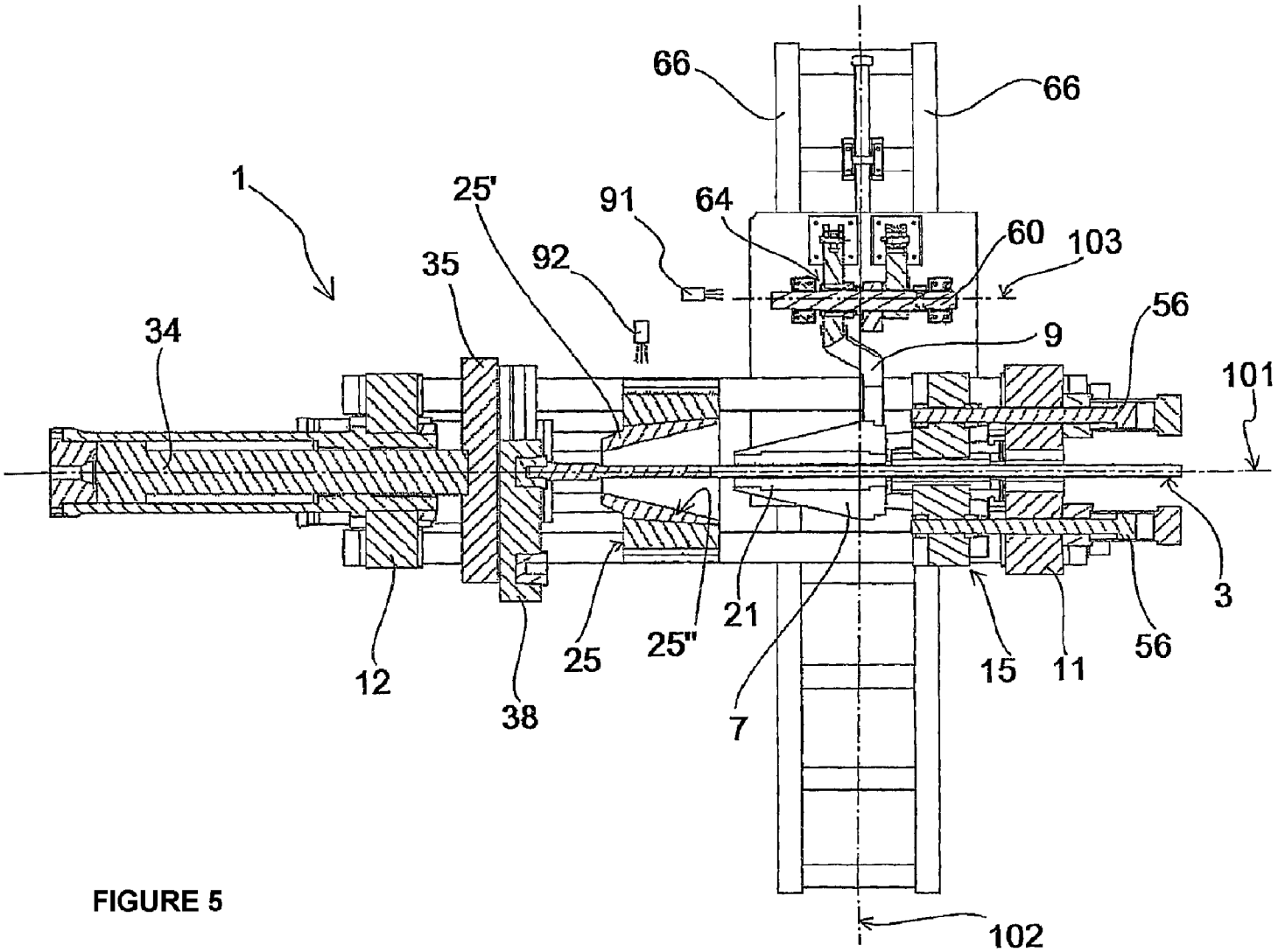
FIG. 5 is a plan view of the press in FIG. 3 in a second operating configuration.
Figure 6:
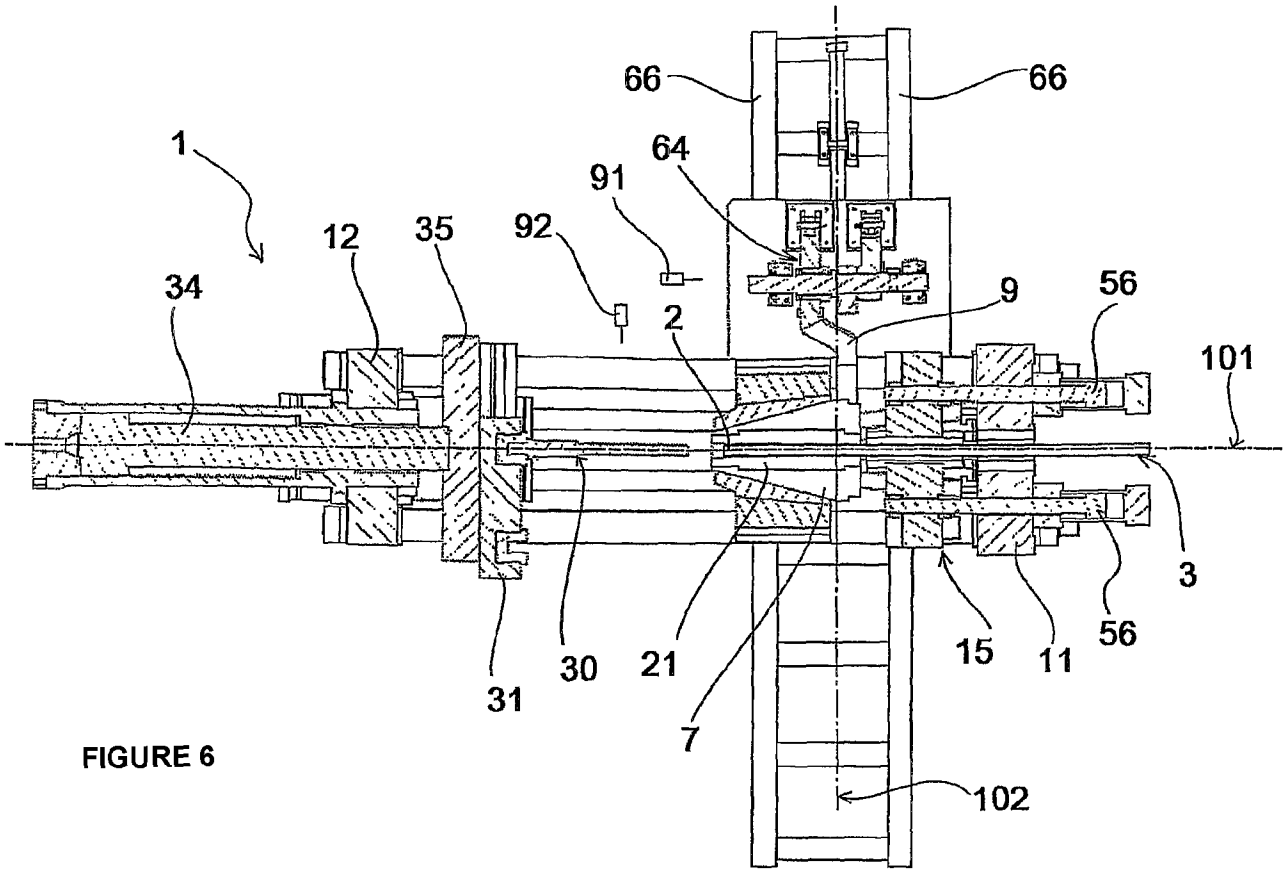
FIG. 6 is a view of the press in FIG. 3 in a third operating configuration.

The press 1 illustrated in figures from 2 to 5 allows to implement a first one-blow upsetting process of an end 2 of a metallic material pipe 3, e.g. for petroleum applications. The steps of this first upsetting process are described below:

- the pipe 3 is inserted in the press 1 from the insertion and extraction side defined by the first fixed crosspiece 11 and axially locked in a predetermined position (see FIGS. 3 and 4);
- the first die holding means are moved from the non-operating position to the operating position (see FIG. 5);
- the first punch 30 is moved from its non-operating position to its operating position (see FIG. 5);
- the first die holding means carry the first half dies 21, 22 to the approaching position so that they surround the end 2 of the pipe 3 to be upset without coming into contact with said end;
- the second locking means are thus actuated to firstly bring and then lock the first half dies 21, 22 to the closing position (movement of the second crosspiece 21 front the non-locking position to the locking position shown in FIG. 6);
- the first punch 30 is moved by said axial actuating means front the first axial position to the second axial position producing the upsetting of the pipe end in this manner;
- the first punch 30 is moved from the second axial position to the first axial position;

the first punch 30 is moved from the operating position to the non-operating position where, when reached, it is cooled and lubricated by means of said second treatment means;

the second locking means are deactuated (movement of the second crosspiece 25 from the locking position to the non-locking position);

the first die holding means bring the two half dies 21, 22 to the distancing position (opening position);

the first die holding means are moved from the operating position to the non-operating position in which the first half dies 21, 22 are cooled and lubricated by means of said first treatment means 91;

the pipe 3 is extracted from the same side of the press 1 through which it was previously inserted.

According to a further aspect of the present invention, the press 1 comprises longitudinal adjusting means of the half dies. In particular, such means have the function of moving the half dies 21, 22 along the direction of me longitudinal axis 101, so that they assume a predetermined position along such an axis 101.

According to a preferred embodiment such a predetermined position of the half dies 21, 22 is defined by a first reference surface 23' defined by the first locking means and by a second reference surface 23" defined by the die holding members 7, 77. In the illustrated solution, the first reference surface 23' is defined by an end surface of the inner jaws 17 which emerges from the feeding body 18 in direction of the second fixed crosspiece 14. The second reference surface 23" is instead defined by the end surface of the bodies of the die holding members 7, 77 facing the first locking crosspiece 15, i.e. facing precisely the inner jaws 17. The first reference surface 23' and the second reference surface 23" develop on planes substantially orthogonal to the longitudinal axis 101.

The adjusting means of the longitudinal position of the first half dies 21, 22 are configured so as to determine a movement along the longitudinal axis 101 such that the second reference surface 23" comes into contact with the first reference surface 23' (see FIGS. 5 and 6). For such a purpose, such adjusting means comprise a drive 64, installed on the supporting carriage 50, which moves, in the two possible translation senses, the first die holding means (in particular, the arms 9, 99) along the shaft 60 which defines the rotation axis 103.

From the operating point of view, such axial adjusting means am actuated when the two half dies 21, 22 occupy the operating position. In other words, alter the movement of the half dies 21, 22 from the non-operating position (outside the working space) to the operating position (inside the working space), the same first half dies 21, 22 are moved towards the first locking crosspiece 15 to allow the contact between the two reference surface 23', 23" indicated above (FIGS. 5 and 6). It is worth noting that the indicated solution is particularly advantageous from the point of view of mechanical strength.

With reference indeed to the view in FIG. 6, it is worth noting that during the upsetting operation the half dies 21, 22 are stably locked in axial direction between the first crosspiece 15 sad the second crosspiece 25. In particular, the forces in axial direction determined by the penetration of the first punch 30 are transferred from the die holding bodies 7 to the inner locking jaws 17 and thus to the feeding body 18, in essence, according to this solution the members used to lock the pipe 3 (i.e. the first locking crosspiece 15) also contribute to the axial locking of the half dies 21, 22 with obvious advantages in terms of strength and safety.

It is worth noting that the predetermined axial position of the half dies 21, 22 is always the same, regardless of whether upsetting is completed with one blow or two blows or with a third blow after a second heating of the end 2. In this latter case, it is worth noting that, the axial position of the pipe 3 mast be varied with respect to the position assigned for the previous two upsetting blows. In particular, the axial position of the pipe 3 for the third blow is established as a function of the geometry features determined by the previous two upsetting blows, i.e., so as to avoid the contact, during the step of closing, between the two half dies 21, 22 and the end of the already upset pipe 2.

Figures from 7 to 15 relate to a second embodiment of a press (indicated by reference 1') according to the present invention which distinguishes it from the first embodiment (FIGS. 2 to 6) mainly for the presence of second upsetting means conceptually and functionally similar to the first upsetting means indicated above. Hereinafter, parts in common in the two embodiments will be indicated using the same reference numbers.

More specifically, such second upsetting means comprise a second die defined by two second half dies 21', 22' which can be separated and closed about said end 2 to be upset of said pipe 3. The second upsetting means further comprise a second punch 30' movable along the longitudinal axis 101 between a first, axial position and a second axial position, at least one of which characteristic of a condition in which the second punch 30' is inserted in the end 2 to be upset. Hereinafter in the description the expressions "first axial position" and "second axial position" are characteristic of a condition in which the second punch 30' is not inserted and in which the second punch 30' is inserted in said end 2 to be upset of said pipe 3, respectively.

The press 1' comprises second die holding means which support the second half dies 21', 22' moving them between an approaching position and a distancing position (opening) similarly as that perforated by said far die holding means for the first half dies 21, 22 of said first die. Again similar to the fat die holding means, the second die holding means are also independent from the supporting structure 10 of the press 1 and are movable along a direction parallel to the transversal direction 102 between an operating position and a non-operating position. The expression "operating position" of said second die holding means indicates a first transversal position such that the second half dies 21', 22' of said second die may he closed about die end 2 to be upset of said pipe 3, while the expression "non-operating position" of said second die holding means indicates a second transversal position, different fern the first such that the same second half dies 21', 22' can be cooled and/or lubricated outside the working space defined by said structure 10 of said press 1'.

Figure 7:
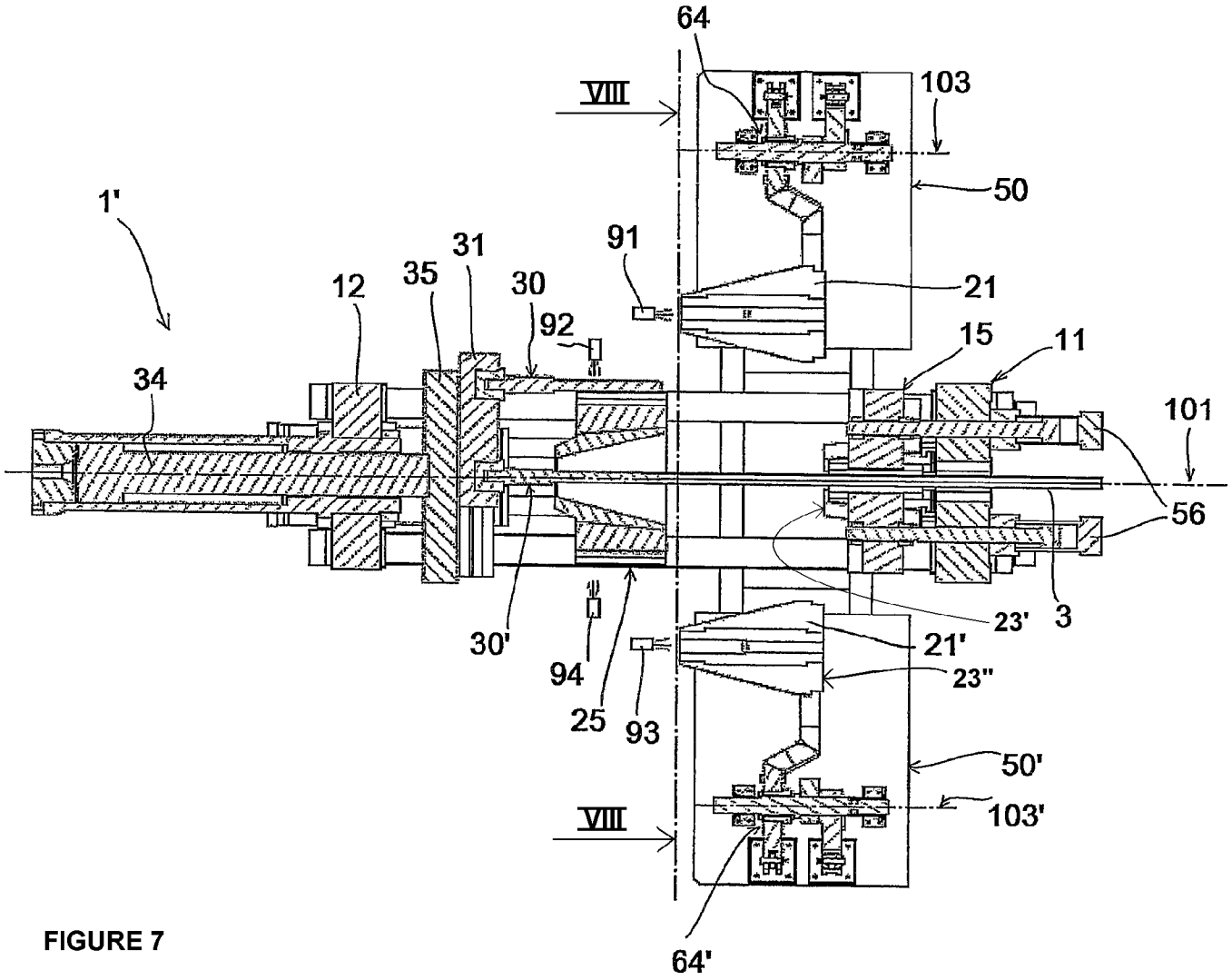
FIG. 7 is a view related to a second embodiment of a press according to the present invention in a first operating configuration.

According to a fat preferred embodiment of the invention shown in FIG. 7, the non-operating position of the second die holding means is substantially symmetric, with respect, to the longitudinal axis 101, to the non-operating position of the first die holding means, in other words, the fat die holding means and the second die holding means move on symmetric rectilinear paths with, respect to said longitudinal axis 101. With this regard, it is worth noting that the press comprises third treatment means 93 that act. in position symmetric to the first treatment means 01 with respect to said longitudinal axis 101.

Figure 8:
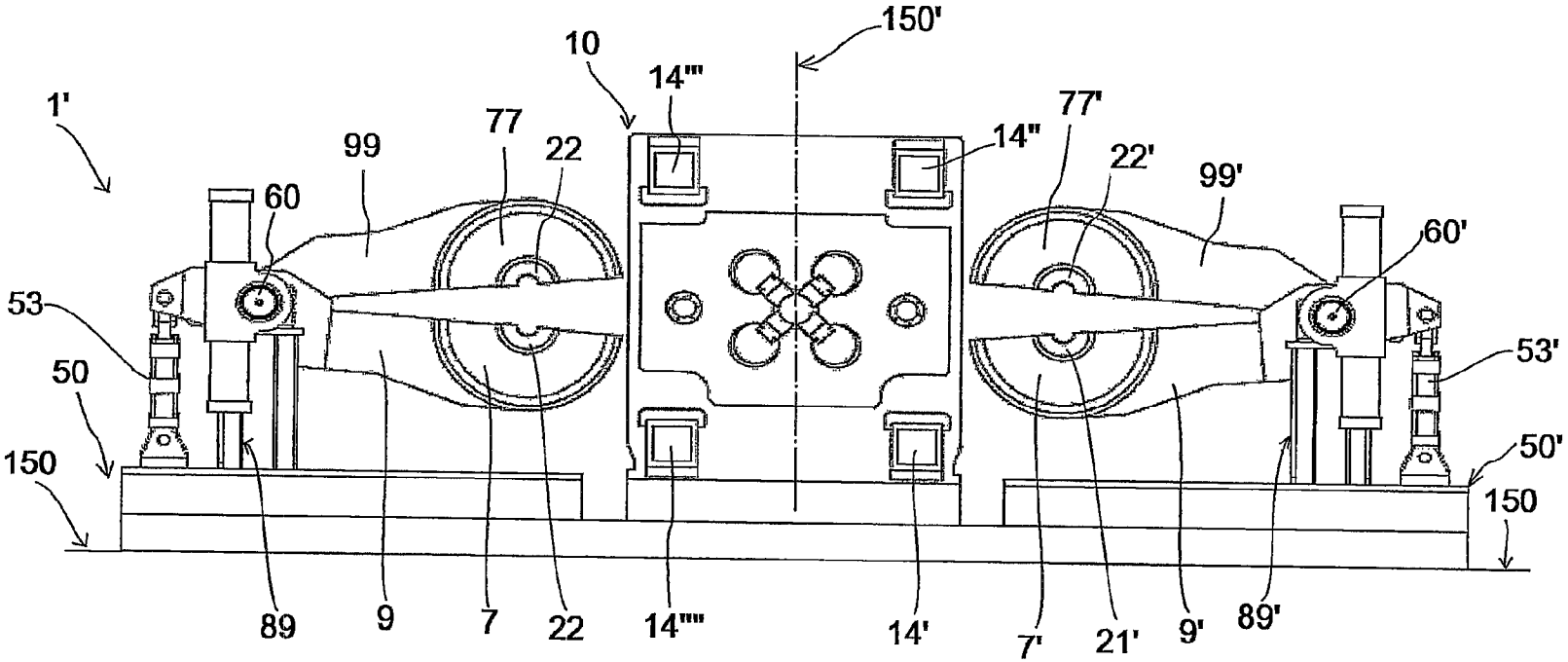
FIG. 8 is a section view taken along line VIII-VIII in FIG. 7.
Figure 9:
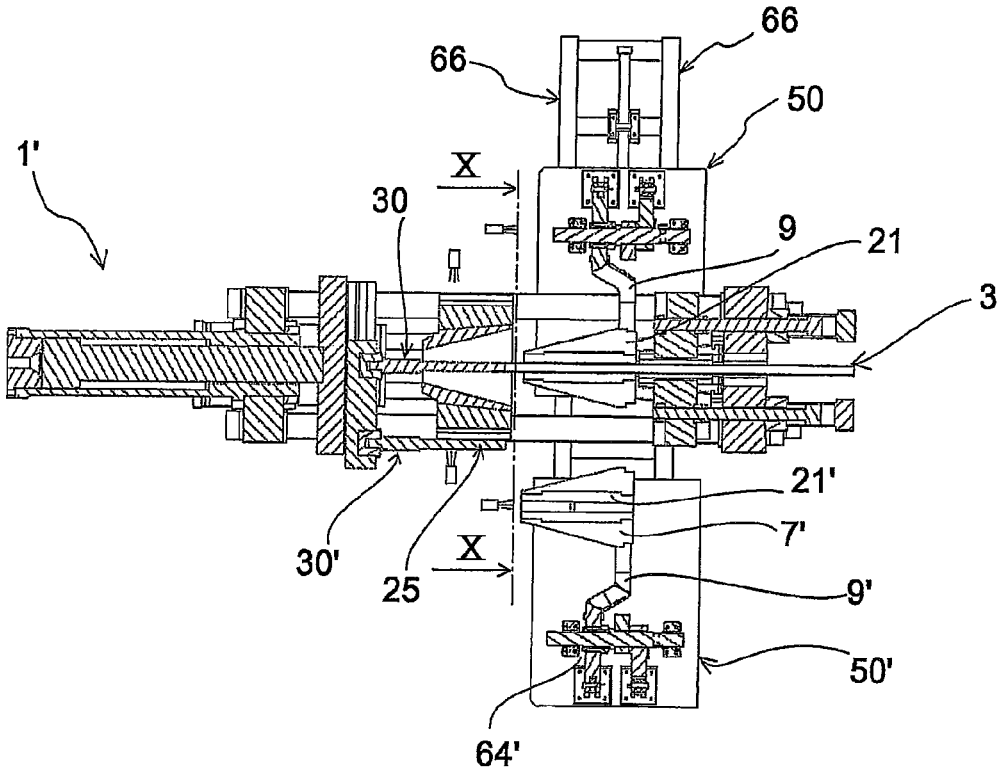
FIG. 9 is a view of the press in FIG. 7 in a second operating configuration.
Figure 10:
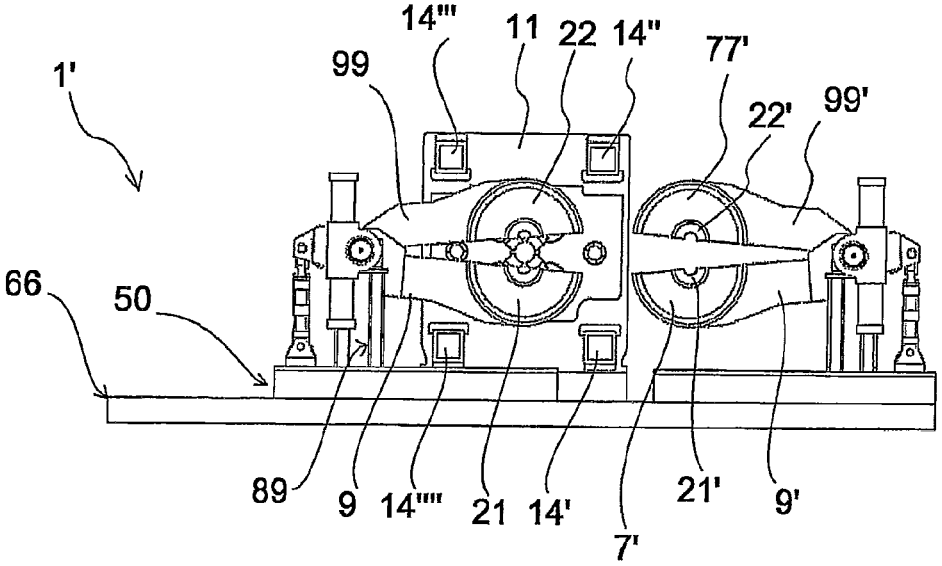
FIG. 10 is a section view taken along line X-X in FIG. 9.

The second die holding means have a conformation substantially equivalent, to that, of the first die holding means. With this regard, FIG. 8 is a front view showing the first die holding means and the second die holding means in a position reciprocally symmetric to the vertical plane 150' containing the longitudinal axis. As shown, the second die holding means comprise second die holding members 7', 77' each of which internally comprises a body within which one of said second half dies 21', 22' of said second die is located. The second die holding means further comprise a second pair of rotating arms 9', 99' each of which supports one of said die holding members 7' on an end. Such rotating arms 9, 99' rotate about a rotation axis 103' (defined by a shaft 60') parallel to said longitudinal axis 101 of the press and defined, in the illustrated case, by a shaft 60' supported by a supporting base 89'. The rotating arms 9', 99' move the second half dies 21', 22', by means of fifth hydraulic means 53', between the approaching position and the distancing position indicated above. As shown in FIG. 7, the bodies of the die holding members 7', 77' of the second die holding means have a half-cone shaped outer surface geometrically conforming to the conical surface 25" of the inner portion 25' of the second locking crosspiece 25.

The press 1' comprises third transversal moving means to move the second die holding means between die operating position and the non-operating position indicated above. In particular, such third transversal moving moans comprise a second carriage 50' and a plurality of guides 66 which allow the movement of the second carriage 50' on the opposite side, with respect to the longitudinal axis 101, on the side on which the first carriage 50 is moved. The second die holding means are installed on said second carriage 50' similarly as required tor the first die holding means installed on the first carriage 50. As apparent in the figures, the first carriage 50 and the second carriage 50' are moved along a same pair of guides 66 arranged orthogonally to the longitudinal axis 101 of the press 1.

The second punch 30* is also movable along a direction parallel to transversal direction 102 between an operating position, in which the axis of the second punch 30' is aligned with the longitudinal axis 101, and a non-operative position in which the punch may be cooled and/or lubricated outside the working space defined by the supporting structure. Preferably, the non-operating position of the second punch 30' is symmetric to the non-operating position of the first punch 30 with respect to the longitudinal axis 101. It is observed that press 1 comprises fourth treatment means 94 which act in a symmetric position to said second treatment means 92 with respect to said longitudinal axis 101.

According to a preferred embodiment illustrated in the figures, the second punch 30' is installed on the same slide 38 on which the first punch 30 is installed. In particular, the two punches 30, 30' are installed so that when said slide 38 occupies the first transversal position, the first punch 30 occupies its operating position and the second punch 30: occupies its non-operating position, and so that when the slide 38 occupies the second transversal position the first punch 30 occupies its non-operating position and the second punch 30' occupies Us operating position.

The press 1' shown in figures from 7 to 15 comprises second adjusting means of she longitudinal position of the half dies 21', 22' of the second die. Such second adjusting means are constructively and conceptually entirely similar to the first adjusting means described above. Reference is therefore made to such a part of the description. It is worth noting that front the constructive point of view such second adjusting means are equivalent to the first, adjusting means and are associated to the second carriage 50'. In particular, the second adjusting means comprise a drive 64' (indicated in FIG. 7) which allows an axial movement of the second die holding means with respect to the carriage itself so that the second half dies 21', 22' are arranged in the predetermined axial position. The latter corresponds to the same axial position indicated for the first half dies 21, 22 and identified by the reference surfaces 23', 23" (also indicated in FIG. 7).

Figure 15:
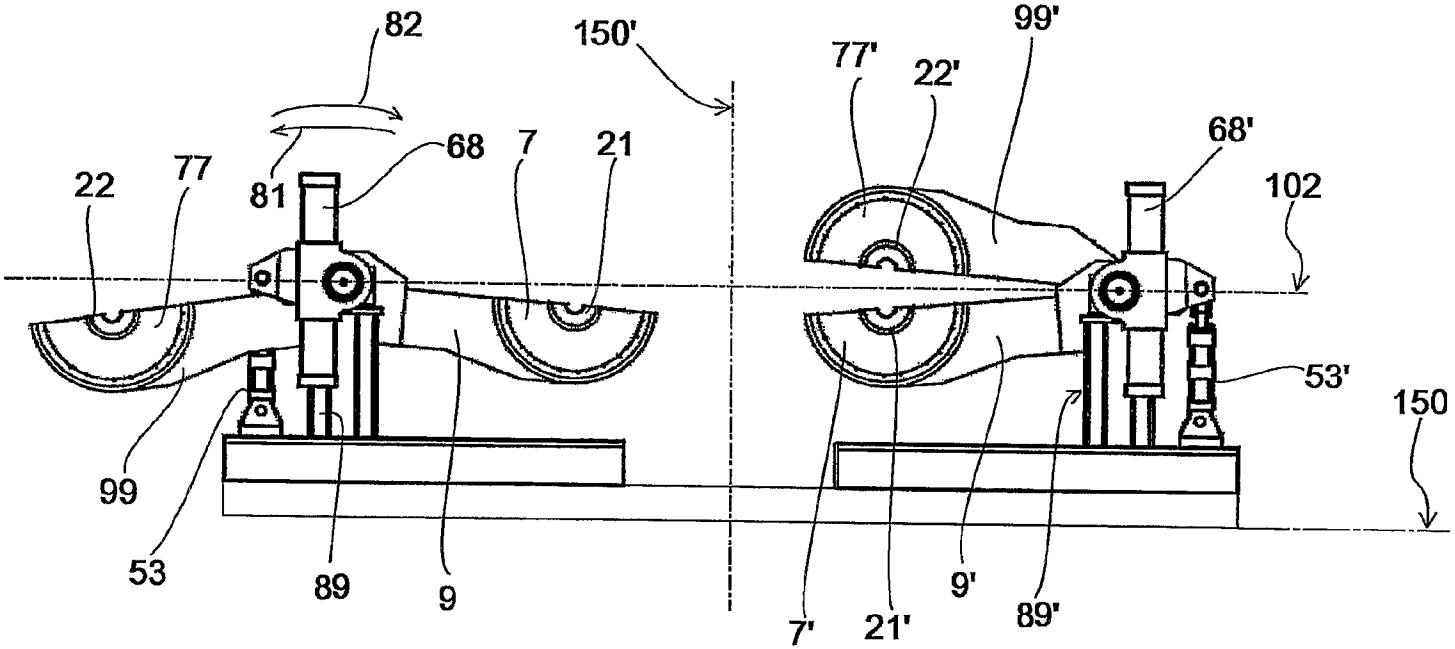
FIG. 15 is a view related to die holding means of a press according to the present invention.

FIG. 15 shows a former advantageous aspect, valid for both the first and the second embodiment of the press according to the invention. In particular, FIG. 15 shows only the first die holding means and the second die holding means in the respective non-operating position, it is worth noting that the second die holding means comprise a further drive 68 such as to allow a rotation greater than 90 degrees of the upper are 99 with respect to the lower arm 9, and preferably of approximately 180 degrees. Such a rotation allows to make a quick die change in total safety according to the procedure described below. In particular, reference is made to the first die holding means, but the same considerations also apply to the second die holding means indicated above and supported by the second carriage 50'.

The first die holding members 7, 77 are brought to the closing position, when the non-operating position is reached, so that the first half dies 21, 22 are in contact and define the first die, The upper half die 22 is farther connected to the upper die holding member 77 by means of temporary connection, means (not shown). As a result of such a connection, the upper arm 99 is turned by 180 degrees (according to the arrow 81) by means of the further drive 68 to roach the configuration shown in FIG. 15. In this position, the connection means (not shown), which connect each, of the first half dies 21. 22 to the respective die holding member 7, 77, are removed, ft is worth noting that in this condition the upper half die 22 remains in all cases connected to the upper die holding member by means of the temporary anchoring means.

By means of further intervention of the drive 68, the upper arm 99 is returned to the closing position (arrow 82) so that the two half dies 21, 22 reconstruct the first die. The temporary anchoring means are at this point removed so as to completely disconnect the upper half die 22 from the upper die holding member 77. At this point, the upper arm 99 is turned again, again by means of the drive 68, in the opening sense by 180 degrees (sense of the arrow 81). Having reached this condition, the first die (i.e. the whole formed by the first two half dies 21, 22) is completely supported by the lower arm 7 and may thus be easily removed by means of conventional lifting means, such as, for example, a bridge crane, and thus replaced e.g. with another die of different size.

As indicated above, this die changing procedure can obviously also be used to replace the second die. For this reason, the second die holding means preferably also comprise a drive 68' adapted to turn the upper arm 99' by 180 degrees according to the method illustrated above. It is worth noting that the die change procedure as that described above can be actuated by virtue of the particular non-operative arrangement assumed by the die holding means (first or second, accordingly) which is indeed outside the working space of the press. It is further worth noting that this die replacement method is extremely rapid, safe and does not require particular equipment or particularly specialized personnel.

The configuration of press 1 shown in figures from 7 to 15 advantageously allows to implement, various operating cycles which make the press 1' itself particularly versatile from the functional point of view. In particular, the press 1 in figures from 7 to 15 allows to implement a first high-speed one-blow upsetting operating cycle and a second high-productivity two-flow upsetting operating cycle. The steps of such cycles are described below.

High-speed One-blow Cycle

This first operating cycle assumes that the two punches 30, 30' have the same size and similarly that the two dies of the press 1 have the same size and the same shape. Such an Operating cycle includes in essence to upset an end of a pipe, for instance, by using first upsetting means (first punch 30 and first half dies 21, 22), while the second upsetting means (second punch 30' and second half dies 21', 22') are cooled and lubricated in their "non-operating" position. The upsetting of the end of a second pipe, subsequent to the first, is instead carried out by means of the second upsetting means, while the first means am cooled and lubricated, i.e. arranged for a subsequent upsetting blow which will be carried out on an end of a third pipe subsequent to the second pipe.

In other words, this first operating cycle includes making the first upsetting means and the second upsetting means work, in alternating manner so that when ones are engaged in upsetting the others are cooled and lubricated. It is apparent that by means of this solution, the dead times of the production cycle are only represented by the insertion and extraction times of the pipe from the press. In essence, the cooling and the lubrication of the upsetting means have no impact at all because these operations are carried out while the press is working.

Figure 11:
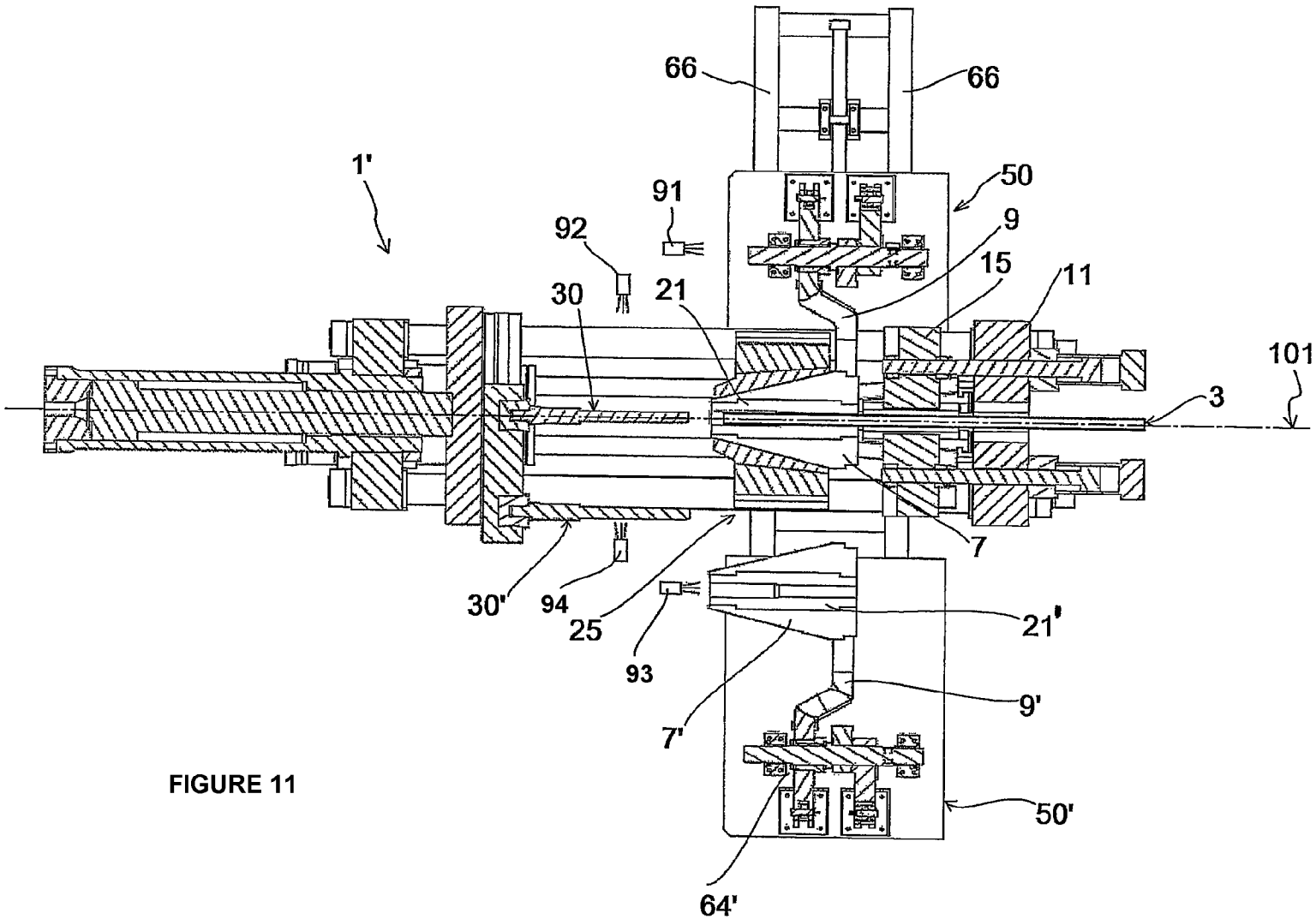
FIG. 11 is a view of the press in FIG. 7 in a third operating configuration.
Figure 12:
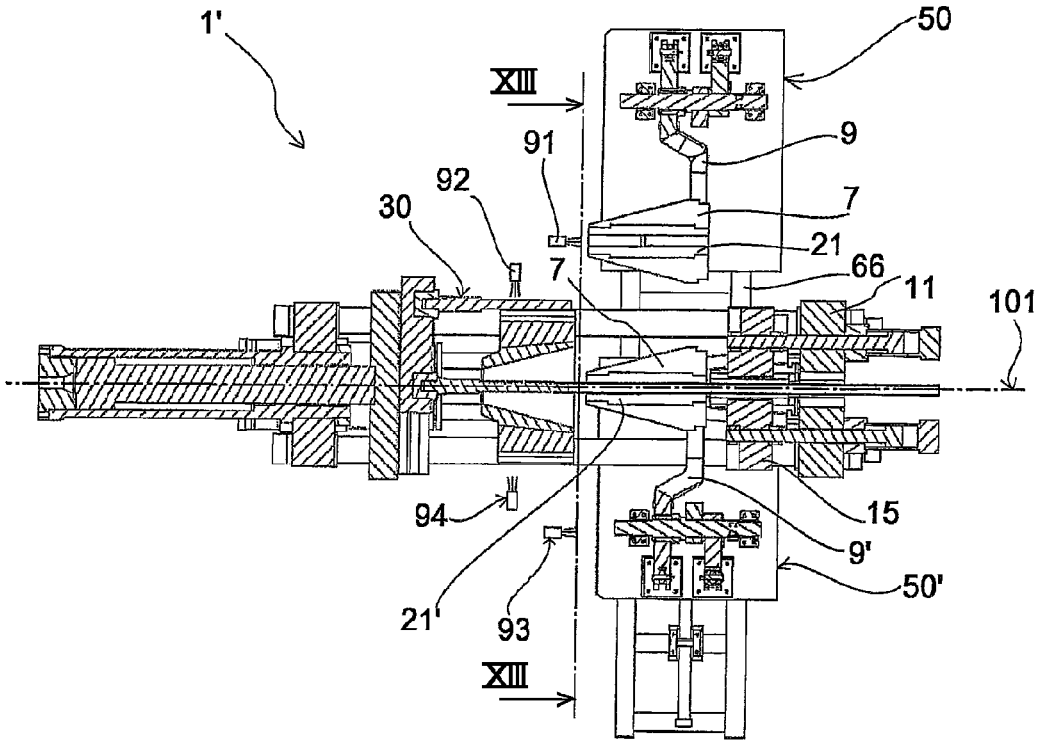
FIG. 12 is a view of the press in FIG. 7 in a fourth operating configuration.
Figure 13:
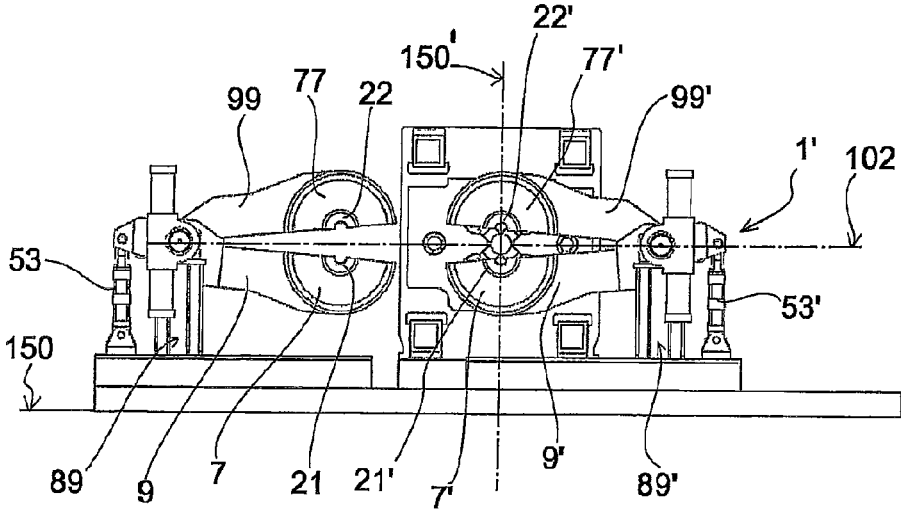
FIG. 13 is a section view taken along line XIII-XIII in FIG. 12.

This advantageous condition is allowed precisely by the non-operative position outside the working space of the press which can be reached by the first and by the second die holding means. It has been seen that through the press 1' in the configuration shown in figures from 7 to 15 it is possible to halve the one-blow upsetting time with respect to the use of the press 1 shown in figures from 2 to 6. The steps of this first upsetting process are described below:

- a first pipe is inserted in the press 1' from the insertion side defined by the supporting structure 10;
- the first pipe is looked by actuating the first locking means;
- the first upsetting means are actuated, i.e. the first die holding means are moved from their non-operating position to their operating position, while the first punch 30 is moved from its non-operating position to its operating position;
- the second locking means 15 are actuated so as to lock the first half dies 21, 22 of the first die in the closing position (movement of the second movable crosspiece 25 from the non-locking position to the locking position);
- an upsetting blow is applied on the end to be unset of the first pipe by moving the first punch 30 from the first axial position to the second axial position, and vice versa:
- the first upsetting means are deactuated (i.e. the first die holding means are moved from their operating position to their non-operating position, and the first punch 30 is moved from its operating position to its non-operating position);
- the first upsetting means are cooled and lubricated;
- the first locking means are deactuated and the first pipe is extracted;
- a second pipe is inserted in the press 1' and locked by actuating the first locking means 15;
- the second upsetting means am actuated (i.e. the second die holding means are moved from their non-operating position to their operating position, while the second punch 30' is moved from its non-operating position to its operating position);

the second locking means are actuated so as to lock the second half dies 21', 22' of the second die in the corresponding closing position;

- an upsetting blow is applied on the end to be upset of the second pipe by moving the second punch 30' from the first axial position to the second axial position, and vice versa;
- the second upsetting means are deactuated, i.e. the second die holding means are moved from their operating position to their non-operating position, and the second punch 30' is moved from its operating position to its non-operating position;

the second upsetting means ate cooled and lubricated;

- the first locking means are deactuated and the second pipe is extracted from the press 1', High-productivity Two-blow Cycle This further operating cycle assumes that the two punches 30, 30' have different size and similarly that the two dies of the press 1 have different size and different shape. Such a second operating cycle in essence includes applying the second upsetting blow while the upsetting means (first and second), used for the first upsetting blow, are washed and lubricated at their non-operating position, in this regard, FIG. 11 shows the press 1 in FIG. 7 during the execution of the first upsetting blow made, in the example shown, by means of the first upsetting means. In particular, if is worth noting that the pipe 3 is inserted in the press 1' and is axially locked in a predetermined position. The first half dies 21, 22 are closed about the end 2 of the pipe a and locked to the second movable crosspiece 25 moved into the locking position in. FIG. 11, the first punch 30 is shown before the movement from the first to the second axial position, i.e. during the execution of the first upsetting blow.

Again with reference to FIG. 11, it is worth noting that during the execution of the first upsetting blow the second die holding means occupy the non-operating position and the second half dies 21', 22' of the second die are cooled and lubricated by means of the third treatment means 93. Similarly, also the second punch 20' is washed and lubricated (by means of the four treatment means 94) also occupying the non-operating position.

Figure 14:
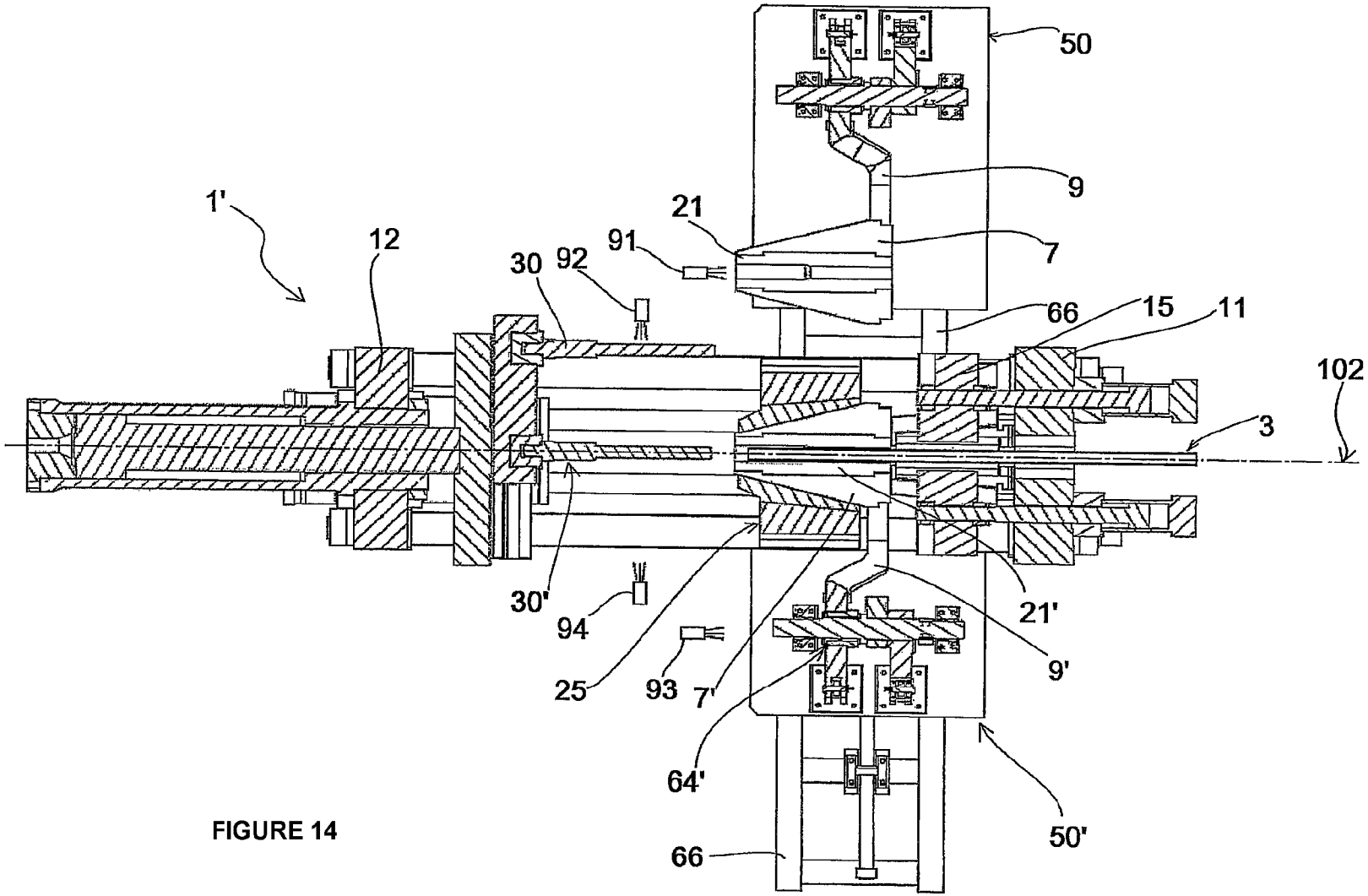
FIG. 14 is a view of the press in FIG. 7 in a fifth operating configuration.

FIG. 14 shows the press 1 in FIG. 11 during the execution of the second upsetting blow made by means of the second upsetting means. In this case, if is worth noting that the second half dies 21', 22' of the second die are closed about the end to be upset, while the first half dies 21, 22 of the first die are cooled and lubricated by means of the first washing and lubricating means 91. Similarly, the second punch 30' is engaged in the execution of the second upsetting blow, while the first punch 30 is cooled and lubricated by the second treatment means 92.

It is worth noting that also in this case, the cooling and lubricating of the dies and of the punches does not affect the dead times of the operating cycle. Indeed, these maintenance operations are carried out while the press 1' is working and during the period needed to extract a pipe 3 upset by the press and to insert another one to be upset. The latter aspect evidently allows to obtain high-productivity particularly with respect to the known solutions in which die half dies am washed and lubricated only when no pipe is positioned inside the press.

For the sake of completeness, the steps of this second upsetting process are also described below:

- a pipe 3 is inserted in the press f from the insertion side defined by the supporting structure 10 and locked by actuating the first locking means;
- the first upsetting means arc actuated (i.e. the first die holding means arc moved from their non-operating position to their operating position, while the first punch 30 is moved from its non-operating position to its operating position);
- the second locking means 15 are actuated so as to lock the first half dies 21, 22 of said first die in the closing position (movement of the second movable crosspiece 25 from the non-locking position to the locking position);

a first upsetting blow is applied on the end to be upset of the pipe 3 by moving the first punch 30 from the first axial position to the second axial position, and vice versa;

the first upsetting means am deactivated (i.e. the first die holding means are moved from their operating position to their non-operating position, and the first punch 30 is moved from its operating position to its non-operating position);

the first upsetting means are cooled and lubricated;

the second upsetting means are actuated (i.e. the second die holding means are moved from their non-operating position to their operating position, while the second punch 30' is moved from its non-operating position to its operating position);

the second locking means are actuated so as to lock the second half dies 21', 22' of the second die in the corresponding closing position;

a second upsetting blow is applied on the end to be upset of the pipe 3 by moving the second punch 30' from the first axial, position to the second axial position, and vice versa;

the second upsetting means am deactivated, i.e. the second die holding means are moved from their operating position to their non-operating position, while the second punch. 30' is moved from its operating position to its non-operating position);

the second upsetting means am cooled and lubricated;

the first locking means are deactuated and the pipe 3 is extracted from the press 1'.

The press according to the invention allows to folly fulfill the predetermined tasks and objects, in particular, it allows easy cooling arid easy lubrication of the upsetting means used as well as a rapid replacement thereof by virtue of the non-operating positions which can be reached by such upsetting means outside the working space of the press. Furthermore, the press has a particularly compact configuration and small dimensions by virtue of the principle of movement of the die holding means, i.e. by virtue of the fact that such die holding means are independent from the supporting structure of the press. Furthermore, the press according to the invention has a high functional versatility being able to apply a high speed one blow upsetting cycle and a high-productivity two blow upsetting cycle.

The invention claimed is:

1. An upsetting press for upsetting an end of a pipe made of metallic material, said press comprising:

a supporting structure, which defines a longitudinal axis of said press and a transversal direction substantially orthogonal to said longitudinal axis, said structure delimiting a working space of said press;

first locking means adapted to lock said pipe in a predetermined position along said longitudinal direction;

first upsetting means comprising:

at least one first upsetting die incorporating two first half dies which can be separated and closed around said end of said pipe;

at least a first punch movable along said longitudinal axis between a first axial position and a second axial position, at least one of said first or second axial positions being characteristic of a condition of said first punch being inserted in said end of said pipe;

first die holding means, which support said first half dies moving them from an approaching position, in which said first two half dies are mutually close, and a distancing position, in which said first half dies are distanced, said first die holding means comprising:

first die holding members each of which comprising a body in which one of said first half dies is housed, said body of said die holding members being tapered according to a direction of insertion of said pipe;

a first rotating arm and a second rotating arm, each or which supports one of said first die holding members, said arms rotating in opposite senses about a rotation axis parallel to said longitudinal axis of said press, second locking means for locking said first half dies in a closing position in which said first half dies surround said end defining said first die, said second locking means comprising a crosspiece movable along said longitudinal direction between a locking position, in which said crosspiece exerts a closing force on said first half dies, and a non-locking position, said movable crosspiece comprising an inner portion which defines a tapered surface conforming to the outer surface of said bodies of said first holding members, wherein said first die bolding means are independent with respect to said structure and are movable along said transversal direction between an operating position, in which said first half dies may be closed about said end of said pipe, and at least one non-operating position outside said working space, and wherein when said two first half dies reach the approaching position about the end of said pipe, then said crosspiece of said second locking means is shifted towards the locking position to close and lock the first two half dies in said closing position.

2. A press according to claim 1, wherein said first punch is movable along a direction parallel to said transversal direction between an operating position, in which the axis of said first punch is aligned with said longitudinal axis of said press, and a first nom operating position outside said working space.

3. A press according to claim 1, wherein said press comprises first adjusting means for adjusting the longitudinal position of said first half dies of said first die, said first adjustment means moving said first half dies to a predetermined axial position.

4. A press according to claim 1, wherein said structure has a configuration substantially symmetric with respect to said longitudinal axis of said press said structure comprising:

a first fixed crosspiece and a second fixed crosspiece which are developed transversally to said axis of said press, said first fixed crosspiece defining an insertion and extraction side of said pipe from said press;

a plurality of longitudinal guiding and supporting beams, which connect said first fixed crosspiece to said second fixed crosspiece, said longitudinal beams delimiting said working space of said press in a direction parallel to said transversal direction, said fixed crosspieces delimiting said working space of said press according to a direction parallel to said longitudinal axis.

5. A press according to claim 1, wherein said press comprises transversal moving means for moving said first die holding means between said operating position and said non-operating position, said transversal moving means comprising a first carriage which supports said first die holding means and one or more rectilinear guides parallel to said transversal direction along which said first carriage can be moved.

6. A press according to claim 1, wherein said first die holding means comprise a drive which allows to turn said second arm with respect to said first arm by an angle greater than 90 degrees.

7. A press according to claim 2, wherein said press comprises;

second upsetting means comprises:

a second upsetting die formed by two second half dies, which can be separated and closed around said end of said pipe;

a second punch movable along said longitudinal axis between a first position and a second position, at least one of said positions is characteristic of a condition in which the second punch is inserted in said end of said pipe ;

second die holding means, which support said second half dies moving them between an approaching position, in which said second half dies are close, and a distancing position, in which said second half dies are distanced and separated, said second holding means comprising:

second die holding members each of which comprising a body in which one of said second half dies is housed, said body of said second die holding members being geometrically conformed to said tapered surface of said inner portion of said second movable crosspiece of said second locking means, a pair of rotating arms each of which supports one of said second die holding members, said arms rotating in about a rotation axis parallel to said longitudinal axis of said press, wherein said second die holding means are independent from said structure and are movable along said transversal direction between an operating position, in which said second half dies may be closed about said end of said pipe, and at least one non-operating position outside said working space.

8. A press according to claim 7, wherein said second punch is movable along said transversal direction between an operating position, in which the axis of said second punch is aligned with said longitudinal axis of said press, and a second non-operating position outside said working space.

9. A press according to claim 7, wherein said second non-operating position of said second die holding means is symmetric, with respect to said longitudinal axis, to said non-operating position of said first die holding means, and/or wherein said non-operating position of said second punch is symmetric, with respect to said longitudinal axis, to said non-operating position of said first punch.

10. A press according to claim 7, wherein said press comprises second adjusting means for adjusting the longitudinal position of said second half dies of said second die, said second adjustment means moving said second half dies to said predetermined axial position.

11. A press according to claim 7, where said press comprises further transversal moving means for moving said second die holding means, said further transversal moving means comprising a second supporting carriage on which said second die holding means are installed and one or more rectilinear guides parallel to said transversal direction along which said second carriage can be moved.

12. A method fur upsetting an end of a metallic material pipe by means of a press according to claim 7, wherein said method comprises the steps of:

inserting a first pipe in said press;

locking said first pipe by actuating said first locking means;

actuating said first upsetting means by moving said first die holding means from said non-operating position to said operating position and moving said first punch from said non-operating position of said first punch to said operating position of said first punch;

actuating said second locking means so as to lock the first half dies of said first die in said closing position;

applying a first upsetting blow on an end to be upset of said first pipe by moving said first punch from said first axial position to said second axial position, and vice versa;

deactuating said first upsetting means by moving said first die holding means from said operating position to said non-operating position and moving said first punch from said operating position of said first punch to said no position of said first punch;

cooling and lubricating said first upsetting means;

deactuating said first locking means;

extracting said first pipe.

13. A method according to claim 12, wherein said method comprises the steps of:

inserting a second pipe in said press;

locking said second pipe by actuating said first locking means;

actuating said second upsetting means by moving said second die holding means from said non-operating position to said operating position and by moving said second punch from said non-operating position of said second punch to said operating position of said second punch;

actuating said second locking means so as to lock the second half dies in said closing position;

applying an upsetting blow on said end of said second pipe by moving said second punch from said first axial position to said second axial position, and vice versa;

deactuating said second upsetting means by moving said second die holding means from said operating position to said no operating position and moving said second punch from said operating position of said second punch to said non-operating position of said second punch;

cooling and lubricating said second upsetting means;

deactuating said first locking moans;

extracting said second pipe from said press.

14. A method according to claim 12, wherein before the step of deactuating said first locking means said method further comprises the steps of:

actuating said second upsetting means by moving said second die holding means from said second non-operating position to said operating position and moving said second punch from said second non-operating position of said second punch to said operating position of said second punch;

actuating second locking means so as to lock the half dies of said second die in said closing position;

applying a second upsetting blow on said end of said first pipe by moving said second punch from said first axial position to said second axial position, and vice versa;

deactuating said second upsetting means by moving said second die holding means from said non-operating position to said operating position and moving said second punch from said operating position of said second punch to said non-operating position of said second punch;

cooling and lubricating said second upsetting means.

15. A method according to claim 13, wherein before the step of deactuating said first locking means said method further comprises the steps of:

actuating said second upsetting means by moving said second die holding means from said second non-operating position said operating position and moving said second punch from said second non-operating position of said second punch to said operating position of said second punch;

actuating second locking means so as to lock the half dies of said second die in said closing position;

applying a second upsetting blow on said end of said first pipe by moving said second punch from said first axial position to said second axial position, and vice versa;

deactuating said second upsetting means by moving said second die holding means from said non-operating position to said operating position and moving said second punch from said operating position of said second punch to said non-operating position of said second punch:

cooling and lubricating said second upsetting means.

* * * * *